US012352128B2

(12) United States Patent
Humphrey et al.

(10) Patent No.: US 12,352,128 B2
(45) **Date of Patent: *Jul. 8, 2025**

(54) SEGMENTED RETAINER FOR HIGH PRESSURE BARRIERS

(71) Applicant: Halliburton Energy Services, Inc., Houston, TX (US)

(72) Inventors: Ryan T. Humphrey, Singapore (SG); Matthew A. Willoughby, Carrollton, TX (US); Richard Decena Ornelaz, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1 day.

This patent is subject to a terminal disclaimer.

(21) Appl. No.: 18/370,925

(22) Filed: Sep. 21, 2023

(65) Prior Publication Data

US 2024/0060384 A1 Feb. 22, 2024

Related U.S. Application Data

(62) Division of application No. 17/179,973, filed on Feb. 19, 2021, now Pat. No. 11,795,777.

(Continued)

(51) Int. Cl.
*E21B 33/12* (2006.01)
*E21B 33/127* (2006.01)

(52) U.S. Cl.
CPC ..... *E21B 33/1208* (2013.01); *E21B 33/1277* (2013.01)

(58) Field of Classification Search
CPC ..... E21B 33/1208; E21B 17/0465; E21B 33/1277; F16L 37/148
See application file for complete search history.

(56) References Cited

U.S. PATENT DOCUMENTS 2,597,482 A * 5/1952 Harrison ..... F16L 37/148 285/305
2,898,136 A 8/1959 Hall, Sr. et al.
(Continued)

FOREIGN PATENT DOCUMENTS

WO 03014521 2/2003

OTHER PUBLICATIONS

United Arab Emirates Office Action for AE Patent Application No. P6002686/2022. PDF file. 10 pages.

(Continued)

*Primary Examiner* — Theodore N Yao
(74) *Attorney, Agent, or Firm* — Scott Richardson; C. Tumey Law Group PLLC

(57) ABSTRACT

Apparatus and methods are disclosed for securing a component, such as a sealing element, to a tubular member, such as a mandrel, of a downhole tool. In at least one example, a retaining ring is used to secure the component to a mandrel. The retaining ring is secured to the mandrel with a plurality of discrete retention segments disposed within a channel at least partially defined by an internal groove on the retaining ring and an external groove on the mandrel. The retention segments are individually insertable into the channel through an access opening on the retaining ring. A compression spring may be provided in the channel to provide compressive engagement of the retention segments. Various closure configurations are also disclosed for closing the access opening once the retention segments have been inserted.

9 Claims, 6 Drawing Sheets

Related U.S. Application Data

(60) Provisional application No. 63/051,666, filed on Jul. 14, 2020.

(56) References Cited

U.S. PATENT DOCUMENTS 3,414,299 A * 12/1968 Roe ..... F16L 37/148 285/302
4,293,148 A 10/1981 Milberger
4,867,483 A * 9/1989 Witt ..... F16L 19/0231 285/23
4,927,192 A * 5/1990 Ungchusri ..... F16L 19/0231 285/388
5,255,945 A 10/1993 Toon
5,383,694 A 1/1995 Taeuber, Jr. et al.
5,743,333 A 4/1998 Willauer et al.
6,644,887 B2 11/2003 Hesse
7,909,110 B2 3/2011 Sharma et al.
8,246,084 B2 8/2012 Poddar
8,702,106 B2 4/2014 Berckenhoff
9,869,157 B2 1/2018 Sevadjian et al.
10,053,954 B2 8/2018 Stautzenberger et al.
10,533,380 B2 1/2020 Fripp et al.
10,619,435 B2 4/2020 Greci et al.
10,626,702 B2 4/2020 Ornelaz et al.
10,723,847 B2 7/2020 Hutchings et al.
11,795,777 B2 * 10/2023 Humphrey ..... E21B 33/1277
2013/0069366 A1 * 3/2013 Morrison ..... F16L 17/02 285/339
2016/0305224 A1 10/2016 Least et al.

OTHER PUBLICATIONS

Office Action Summary for U.S. Appl. No. 17/179,973 dated May 8, 2023.
Final Office Action Summary for U.S. Appl. No. 17/179,973 dated Oct. 14, 2022.
Office Action Summary for U.S. Appl. No. 17/179,973 dated Jun. 7, 2022.

* cited by examiner

SEGMENTED RETAINER FOR HIGH PRESSURE BARRIERS

CROSS-REFERENCE TO RELATED APPLICATIONS

This is a divisional of U.S. application Ser. No. 17/179,79, filed Feb. 19, 2021, which is a nonprovisional application claiming priority to U.S. Provisional Patent Application No. 63/051,666, filed Jul. 14, 2020, the entire disclosures of which are incorporated herein by reference.

BACKGROUND

A variety of tools are used in drilling, completion, stimulation, and production of oil and gas wells. Took are often tubular, to conform with the generally round profile of the drilled well and with other tubular tools. For example, a well may be drilled with a drill bit at the lower end of a string of tubular drill pipe that is progressively assembled to reach the desired well depth, and then removed. During drilling, fluid is circulated through the drill pipe to lubricate the drill bit and remove cuttings. After drilling, a string of relatively large diameter tubular casing may be lowered into the wellbore and secured by circulating cement downhole and through an annulus between the casing and formation. This casing string reinforces the wellbore and may be perforated at selected depths and intervals for extracting hydrocarbon fluids from a production zone(s) of the formation. The well may be stimulated by sealing off and delivering fluid to selected production zones. Then, a production tubing string may be run into the well to the production zone, protecting the casing and providing a flow path to a wellhead through which the oil and gas can be produced.

In each of the various wellbore operations, it is often necessary to seal between adjacent surfaces between tubular equipment and/or with the wellbore. For example, during fracturing or cementing operations various fluids are pumped into the well and hydraulically forced out into a surrounding subterranean formation. This typically requires sealing the wellbore to provide zonal isolation. Wellbore isolation devices, such as packers, bridge plugs, and fracturing plugs (i.e., "frac" plugs) are designed for these general purposes. Such wellbore isolation devices may be used in direct contact with the formation face of the well or with a string of casing that lines the walls of the well. A universal challenge in downhole sealing systems is to design robust mechanisms that fit within the tight downhole confines.

DETAILED DESCRIPTION

This disclosure includes apparatus and methods for securing any of a variety of components to a tubular member of a downhole well tool. The disclosed examples are particularly well suited to securing a sealing element to a mandrel, for instance. Aspects of this disclosure are directed to retention of such a sealing element or other component in a way that reduces component stress during assembly and related sources of seal failure. The disclosed systems address certain challenges due, for example, to gas tight requirements, high pressure high temperature (HPHT) environments. The disclosed systems and methods are also well suited to dynamic sealing applications where space is limited, where reduced clearances between moving parts are required for seal functionality, and where materials systems are otherwise pushed to their limits.

In some examples, a retaining ring is secured on a mandrel by positioning pre-formed retention segments in a channel defined between the mandrel and retaining ring. The channel is cooperatively defined by a ring groove circumferentially extending along an inner surface of the retaining ring and a mandrel groove circumferentially extending along an outer surface of the retaining ring. The pre-formed segments may be individually inserted into the channel through an access opening on the outer surface of the retaining ring, and progressively sliding them into the channel. A closure, which may be embodied as a retention clip, is used to close the access opening, to optionally fill at least some of the remaining space within the channel not occupied by retention segments, and to secure the retention segments within the channel. Various example configurations are disclosed for the retention segments, the channel, the closure, and detailing other example features and benefits.

Figure 1:
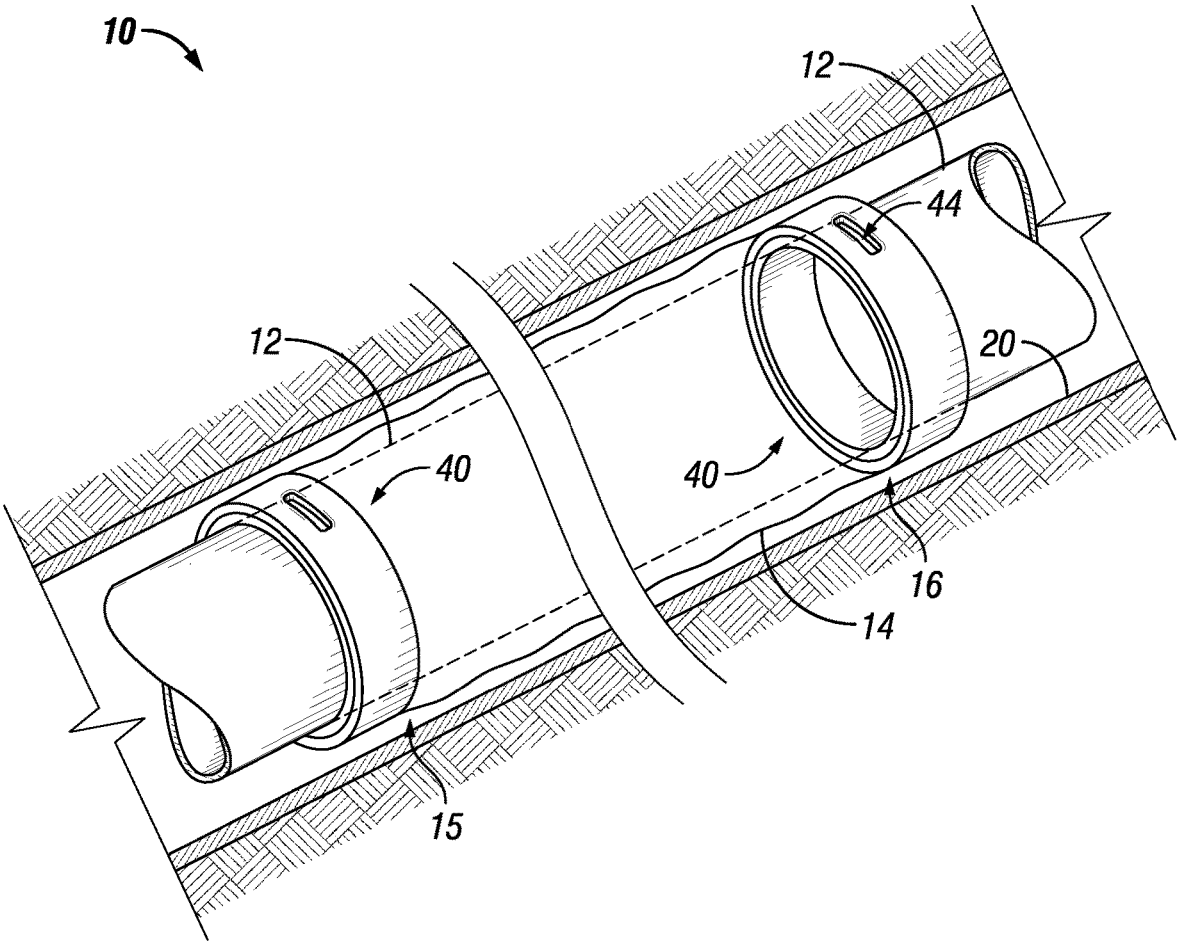
FIG. 1 is a perspective view of an elongate sealing system coupled to a mandrel by a pair of retaining rings.

FIG. 1 is a perspective view of a well tool having a compliant sealing element 10 coupled to a tubular mandrel 12 by a pair of retaining rings 40 according to an aspect of this disclosure. The tool 10 is depicted by way of example as a downhole seal assembly 10 wherein a sealing element 14 is secured to the mandrel 12. The sealing element 14 is deployable by inflating or otherwise expanding the sealing element 14 outwardly seal against an inner surface of a generally circular wellbore 20. The sealing element 14 is secured to the mandrel 12 at opposing ends 15, 16 by the retaining rings 40, which may be substantially identical. The retaining rings 40 secure the ends 15, 16 of the sealing element 14 with sufficient integrity to resist axial forces and movement of the ends 15, 16 such as when the downhole seal assembly 10 is tripped into the wellbore 20 and during expansion of the sealing element 14 against the wellbore 20.

As further discussed below, a ring groove circumferentially extending along an inner surface of each retaining ring 40 and a mandrel groove circumferentially extending along an outer surface of the mandrel 12 cooperatively define an internal, circumferentially extending channel. A plurality of retention segments may be circumferentially disposed within the channel of the retaining ring 40 through an access opening 44. The retention segments prevent axial movement of the retaining rings 40 on the mandrel 12 to axially secure the retaining rings 40 to the mandrel 12. It should be recognized that the downhole seal assembly 10 of FIG. 1 is but one example of how the retaining rings 40 and alternative configurations thereof may be used to axially secure a sealing member or other component about a mandrel, and that other types of seals and even other, non-sealing components may be secured to a mandrel by any number of retaining rings.

Figure 2:
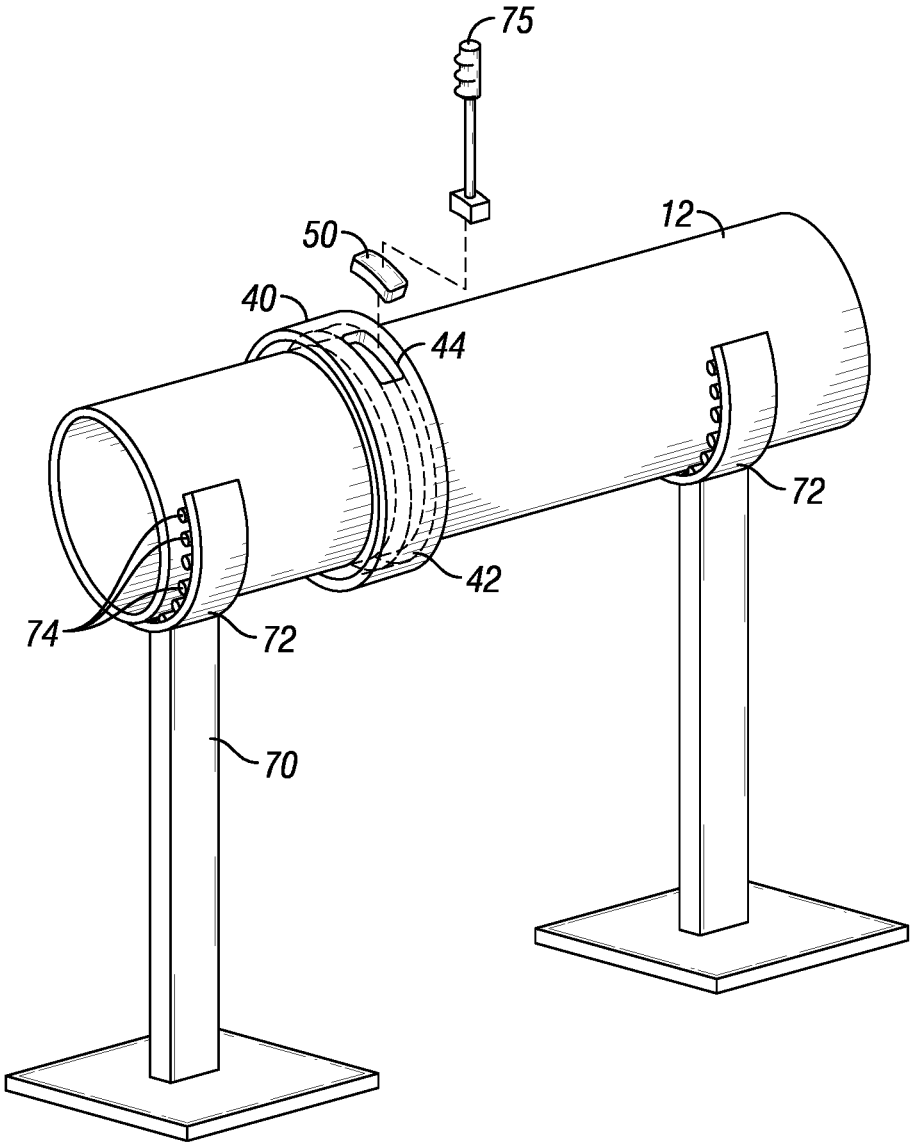
FIG. 2 is a perspective view of the mandrel supported on an optional mandrel stand to facilitate assembly.

FIG. 2 is a perspective view of the mandrel 12 supported on an optional mandrel stand 70 to facilitate manual assembly of downhole seal assembly components including the retaining ring 40 to the mandrel 12 by a technician or other user. The mandrel stand 70 includes support members (e.g. cradles) 72 for supporting the mandrel 12 at opposing ends of the mandrel 12. The mandrel 12 may be hoisted and set down on the stand 70 with a lifting tool, such as a crane (not shown). The cradles may include rollers 74 so that the mandrel may be freely rotated about Ixis. The retaining ring 40 is positioned about the mandrel 12 with the access opening 44 facing generally upward at a convenient height and position for inserting the retention segments 50 by hand. A plurality of the retention segments 50 may be inserted, one at a time, through the access opening 44. An insertion and/or positioning tool 75 may be used to help with assembly of the retaining ring 40 to the mandrel 12. One example of an insertion or positioning tool 75 may have a straight, narrow section to help seat each retention segment 50 inside the retaining ring 40. The tool 75 may also be used to progressively slide each retention segment 50 along the channel to make room for the next retention segment 50 to be inserted. The tool may alternatively be curved to fit into access opening 44 and facilitate sliding the retention segments 50 along the channel 42. In other cases, a conventional tool like a small screwdriver may be suitable, to urge the retention segments circumferentially during installation.

Figure 3:
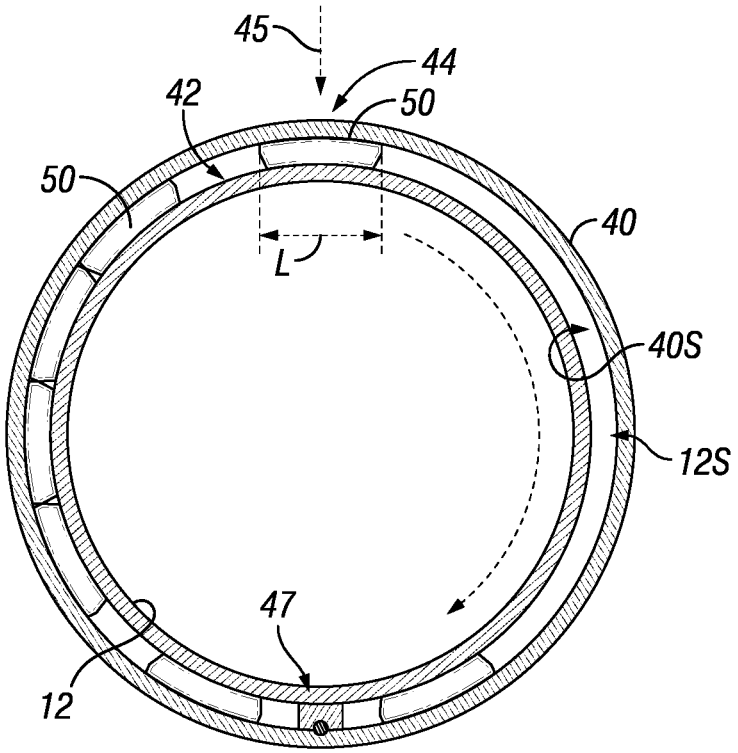
FIG. 3 is a side view of one of the retaining rings of FIG. 1 in a process of assembling the retaining ring to the mandrel.

FIG. 3 is a side view of one of the retaining rings 40 of FIG. 1 in a process of assembling the retaining ring 40 to the mandrel 12. The retaining ring 40 and mandrel 12 are both circular in this example. The retaining ring 40 has been positioned on the mandrel 12, with an inner surface 40S at an inner diameter (OD) of the retaining ring 40 positioned closely about and facing an outer surface 12S at an outer diameter (OD) of the mandrel 12. A circumferential channel 42 is defined between the retaining ring 40 and mandrel 12 by a respective ring groove and mandrel groove discussed below. The channel 42 in this example is a continuous channel that circumferentially extends 360 degrees along a perimeter (circumference) of the retaining ring 40. Alternate configurations may include a channel that extends only partially (less than 360 degrees) along the circumference. The access opening 44 is provided on the outer surface 12S of the retaining ring 40 to the ring groove, for insertion of each retention segment 50 into the channel 42. The access opening 44 is sized to individually receive each retention segment 50. The access opening 44 in this example is slightly longer than a length "L" of the retention segment 50 being inserted, to receive one retention segment 50 at a time through the access opening 44 into the channel 42. Each retention segment 50 may be inserted straight down in the direction of an insertion arrow 45 to be seated in the channel 42.

The retention segments 50 can be inserted by hand, such as by dropping each one directly into the channel 42, using an insertion or positioning tool if necessary. After inserting a particular retention segment 50, the retaining ring 40 and/or mandrel 12 may be manipulated, such as by rotating one relative to the other, to facilitate the movement of the inserted retention segments 50 along the channel 42, so that additional retention segments 50 may be inserted. The retention segments 50 may be individually inserted, one-by-one, until the desired number of retention segments 50 have been inserted, such as to fill or partially fill the channel 42. A tool may be used as necessary (e.g., the tool 75 of FIG. 2) to help position the retention segments 50.

Each retention segment 50 shown in FIG. 2 is substantially identical in size and shape in this embodiment, although embodiments could be constructed with different sizes and shapes of retention segments. The retention segments 50 as seated within the channel 42 radially extend within the ring groove and mandrel groove that cooperatively define the channel 42, to create interference to axial movement of the retaining ring 40 with respect to the mandrel 12. The plurality of retention segments 50 may collectively bear the stress of external loading on the retaining ring 40 and any structure (e.g. a downhole seal assembly component) secured by the retaining ring 40 to the mandrel 12. This amount of retention (e.g., amount of axial load supported) may be dependent on, for example, the shear strength and other material properties of the retention segments 50, the geometry of the retention segments 50, the channel geometry, and the tolerances and clearance between the retention segments 50 and the channel 42.

The channel 42 need not be filled end-to-end with retention segments 50 to secure the retaining ring 40. For example, one or more embodiments may secure the retaining ring by collectively spanning a total of as few as 180 degrees of a 360-degree channel. However, each retention segment 50 added to the channel 42 will generally contribute an incremental amount of retention strength or stability. Thus, increasing the number of retention segments 50 to the channel 42 up to as much as the full 360-degrees of the channel 42 may also contribute to lateral or radial stability of the retaining ring 40 relative to the mandrel 12 by more completely filling up a volume of the channel 42. Thus, in some embodiments, enough retention segments 50 may be provided to substantially fill the channel 42, or leaving enough space for a closure at the access opening 44 and/or an optional spring or other element that occupies some portion of the channel 42 along with the retention segments 50.

Although not strictly required in every embodiment, filling the channel 42 with enough retention segments to collectively span a combined 360 degrees of the channel generally maximizes retention for a given channel and segment configuration. In some embodiments, it is sufficient to have the segments ride loosely in the channel and/or fill less than 360 degrees of the channel 42 because the tool would experience uniform loading (pressure) on all the segments simultaneously. Thus, in some embodiments, enough retention segments will be inserted to span at least half the circumference of the channel, i.e., nominally at least 180 degrees of the channel. This may have some advantages in certain applications, where less than 360 degrees of retention is sufficient to axially secure parts, such as to reduce part count and costs, weight, or rotational friction.

The retaining ring 40 may also be rotationally secured relative to the mandrel 12 with the use of a key or discontinuity 47 on or the mandrel or retaining ring in the channel 42 to limit movement of the retention segments around the mandrel 12. Just one example location of such a key or discontinuity 47 is indicated in the figure, which interferes with relative rotation between the mandrel 12 and retaining ring 40. Although one key or discontinuity 47 is shown by way of example, additional keys or discontinuities could be circumferentially spaced about the retaining ring 40. A key may be a piece of material added within the channel 42, for example. The key could be formed on the retaining ring by any suitable technique including but not limited to welding or press fitting the key into the mandrel groove. A discontinuity could alternatively be formed by simply not machining the mandrel groove completely around the OD of the mandrel 14 but leaving at least a small segment uncut. This may result in the channel 42 extending less than 360 degrees around the circumference of the mandrel 12.

Each retention segment 50 may be pre-formed during manufacturing to conform with the profile of the channel 42. The retention segments may be formed in any of a variety of ways. Various manufacturing processes can be used to produce the segments based on the material, cross section, and tolerance requirements of the retention segments 50. Such manufacturing processes include, for example, spring forming, water/plasma jet, computer numeric controlled (CNC) machining, additive manufacturing, casting, electrical discharge machining (EDM), as well as others. Additionally, the retention segments may be heat treated to obtain specific material properties such a yield strength and elongation.

The retention segments 50 and channel 42 may also be formed with any of a variety of sizes and cross-sectional shapes. Certain cross-sectional shapes can have certain benefits or features, such as strength, rigidity, or ease of assembly. Certain cross-sectional shapes (e.g. an I-beam) may include one or more flanges slidably captured within a portion of the ring groove and/or mandrel groove, enabling the retention segments 50 to take on radial loading in addition to shear loading. Examples of circular, stepped, and I-beam cross-sectional shapes are illustrated in FIGS. 4, 5, and 6.

Figure 4:
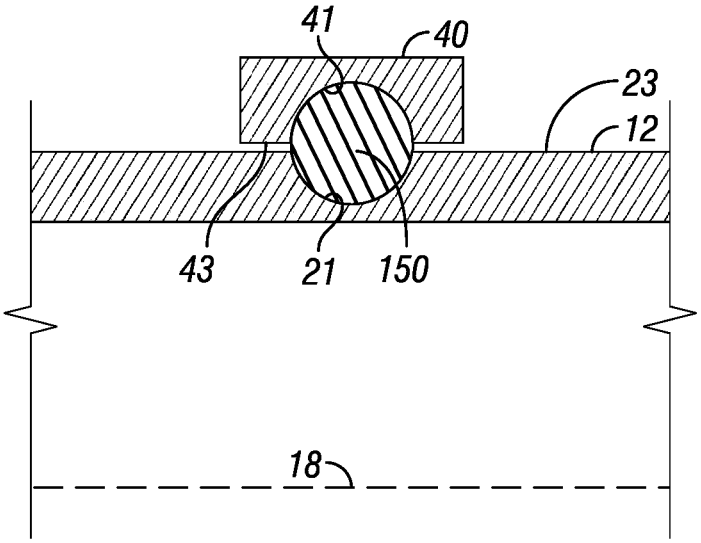
FIG. 4 is a cross-sectional view of the retaining ring secured to the mandrel by a retention segment having a round cross-sectional shape.

FIG. 4 is a cross-sectional view (taken along a plane through the mandrel axis 18) of the retaining ring 40 secured to the mandrel 12 by a retention segment 150 having a round cross-sectional shape. The retaining ring 40 defines a circumferential ring groove 41 around an inner surface 43 of the retaining ring 40. At the same axial location, the mandrel 12 has a circumferential mandrel groove 21 defined on an outer surface 23, e.g., cut into the outer diameter (OD) of the mandrel 12. The ring groove 41 and mandrel groove 21 cooperatively define the channel 42 into which each retention segment 151 is positioned. The cross-sections of the ring groove 41 and mandrel groove 21, by way of example and not by limitation, are each about the same dimensions, as though forming two halves of a circle about the circular retention segment cross-section. The retention segment 151 has a generally round cross-section that conforms with what in this example is a generally circular cross-section of the channel 42. In one or more embodiments, the size of the cross-sections of the retention segments 151 and channel 42 may be selected so that the retention segment 151 extends radially into both the ring groove 41 and mandrel groove 21. The retention segments 151 may at least extend radially above the inner surface 43 of the retaining ring 40 and below the outer surface 23 of the mandrel, sufficient to axially secure the retaining ring 40 on the mandrel 12 under expected loading conditions.

Figure 5:
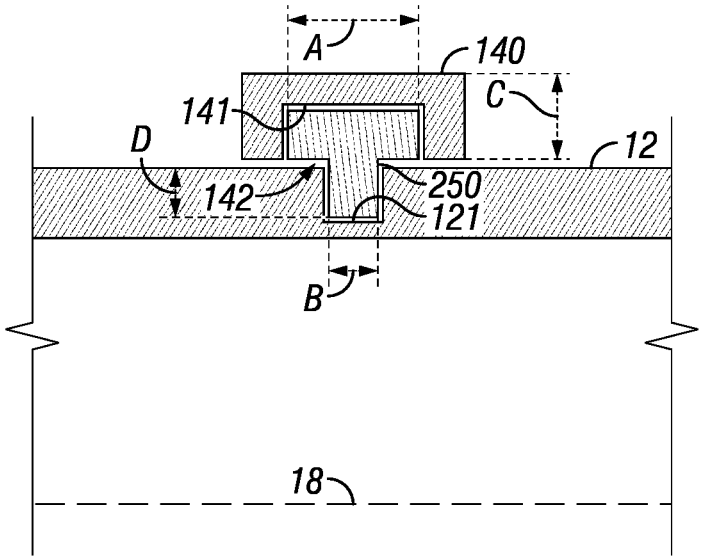
FIG. 5 is a cross-sectional view of an alternative configuration of a retaining ring secured to the mandrel by a retention segment having a stepped cross-sectional shape.

FIG. 5 is a cross-sectional view (taken along a plane through the mandrel axis 18) of an alternative configuration of a retaining ring 140 secured to the mandrel 12 by a retention segment 250 having a stepped cross-sectional shape. A circumferential ring groove 141 and a circumferential mandrel groove 121 define a corresponding step-shaped channel 142 and are each substantially rectangular in cross-sectional shape. The cross-sectional dimensions of the ring groove 141 and of the mandrel groove 121 differ. For instance, a width "A" of the mandrel groove cross-section is larger than a width "B" of the ring groove cross-section. Respective heights "C" and "D" of the ring groove and mandrel groove cross-sections may also differ, such as due the expected loading conditions, strength of materials used, limitations on a wall thickness of the mandrel 12 on which to define a groove profile, and so forth.

Figure 6:
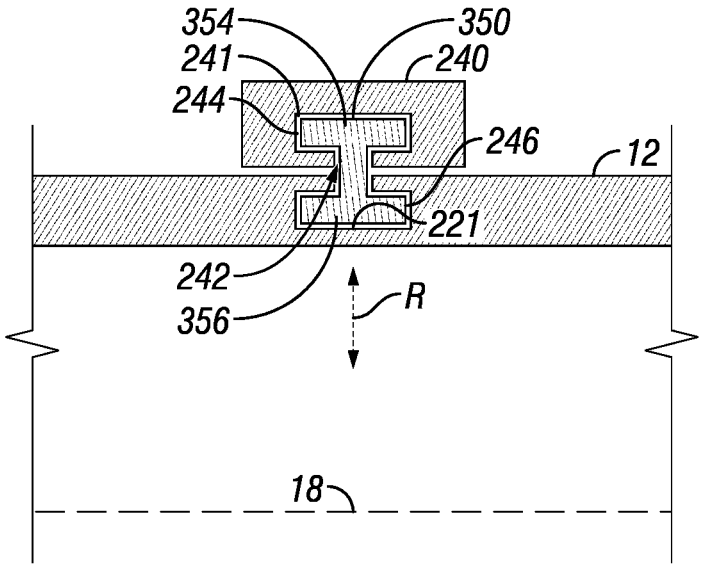
FIG. 6 is a cross-sectional view of yet another alternative configuration of a retaining ring secured to the mandrel by a retention segment having an I-beam shaped cross-sectional shape.

FIG. 6 is a cross-sectional view (taken along a plane through the mandrel axis 18) of yet another alternative configuration of a retaining ring 240 secured to the mandrel 12 by a retention segment 350 having an I-beam shaped cross-sectional shape, disposed in an I-beam shaped channel 242. The I-beam shaped channel is defined by a circumferential ring groove 241 and a circumferential mandrel groove 221 are substantially rectangular in cross-sectional shape. The I-beam shaped retention segment 350 provides additional radial stability to secure the retaining ring 240 in a radial direction indicated at "R." For instance, the I-beam shaped cross-section includes a flange 354, 356 at each end, which are each captured in corresponding portions 244, 246 of the ring groove and mandrel groove.

Those of skill in the art having benefit of this disclosure will appreciate, without further illustration, that a myriad of other cross-sectional shapes are possible beyond these specific examples. Having discussed the different retention segment and channel geometry possible, discussion returns to assembly using of the retaining ring 40 and retention segment 50 of FIG. 3.

Figure 7:
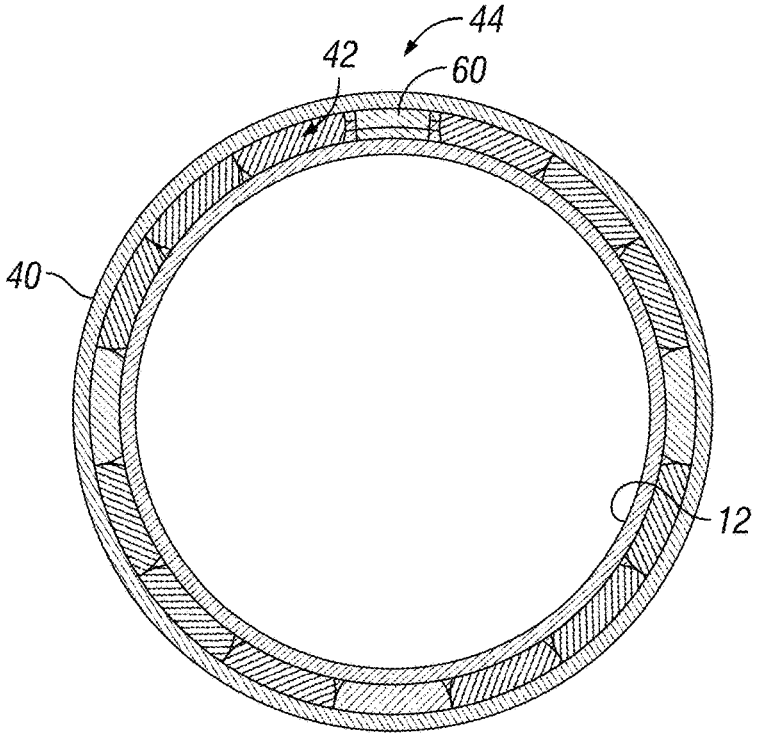
FIG. 7 is a side view of the retaining ring once assembled to the mandrel.

FIG. 7 is a side view of the retaining ring of FIG. 3 once the channel 42 has been filled with as many retention segments 50 as will fit into the channel 42 with enough room left for a closure 60. The closure is used to close the access opening 44 after all the retention segments 50 have been inserted into the channel 42. The closure 60 may also extend radially into the channel to fill any remaining circumferential space between retention segments 50 on either end of the closure 60. The closure 60 in this embodiment is more particularly configured as a retention clip, which may snap into place to prevent inadvertent loss or removal of the retention segments 50. The closure 60 snaps into the channel 42 through the access opening 44 and may releasably lock in place by engaging an internal feature of the retaining ring 40. The retention segments 50 together with the closure 60 now span the entire perimeter (circumference) of the channel 42, abutting end to end.

Figure 8:
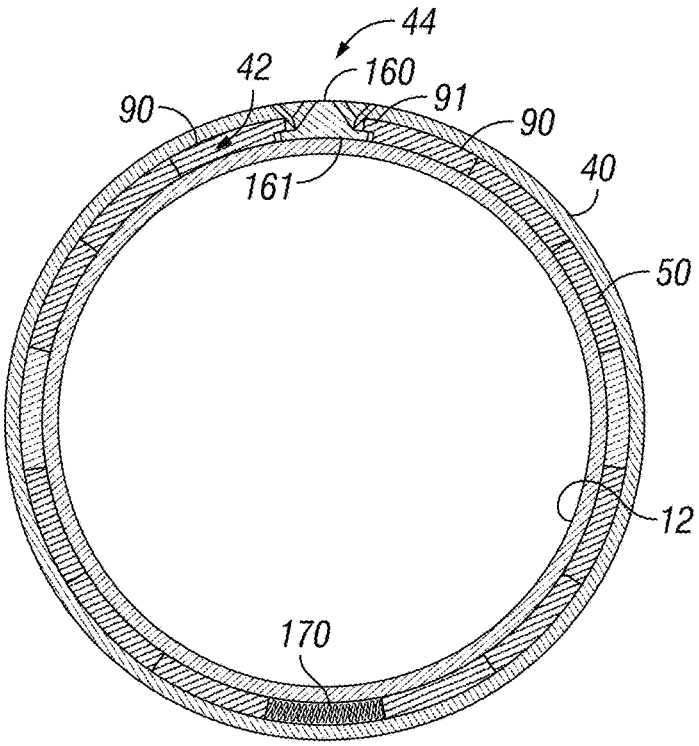
FIG. 8 is a side view of another retaining ring configuration that employs a spring in the channel with interlocking end segments on each end of the closure.

FIG. 8 is a side view of another retaining ring configuration that employs a compression spring 170 and interlocking end segments 90 on each end of a closure 160. As in the above examples, the retention ring relies on interference between retention segments in a channel defined by a ring groove and mandrel groove to axially secure the retaining ring 40 on the mandrel. The retention segments 50 still fill most of the channel 42 but leave enough space in the channel 42 for the spring 170 and closure 160. The spring 170 provides circumferential compression between any moveable members within the channel 42, including between adjacent retention segments 50 and between interlocking end segments 90 and closure 160. A tool (e.g., tool 75 of FIG. 2) may be fashioned to fit within the access opening 44 during assembly to urge the final retention segment 60 circumferentially slightly outwardly, compressing the spring 170 and creating enough room to the insert the closure 160.

The end segments 90, which may be referring to as interlocking end segments, include features that interlock with the closure 60 and remain interlocked while in compressive engagement from the compression provided by the spring 170. In this embodiment, an end segment 90 is provided on each side of the closure 160, which may function like other retention segments 50 in terms of the interference to axial movement of the retaining ring. The end segments 90 also include an end feature 91 that overlaps with an end feature 161 of the closure 160. During assembly, after the retention segments 50 and end segments 90 have been inserted into the channel, the interlocking end segments may be urged outwardly against the compressive force provided by the spring 170 to provide enough space at the access opening 44 to insert the closure 160. In particular, the end segments 90 may be spread apart far enough to create clearance between the overlapping end features 91, 161 to insert the closure 160 into the channel 42. Then, the spring 170 may urges the interlocking end segments circumferentially within the channel 42 back into abutment with the closure 160 and with the end features 91, 161 overlapping. The overlapping end features 91, 161 on either side prevent or resist inadvertent removal of the closure 160 and loss of retention segments 50.

Figure 9:
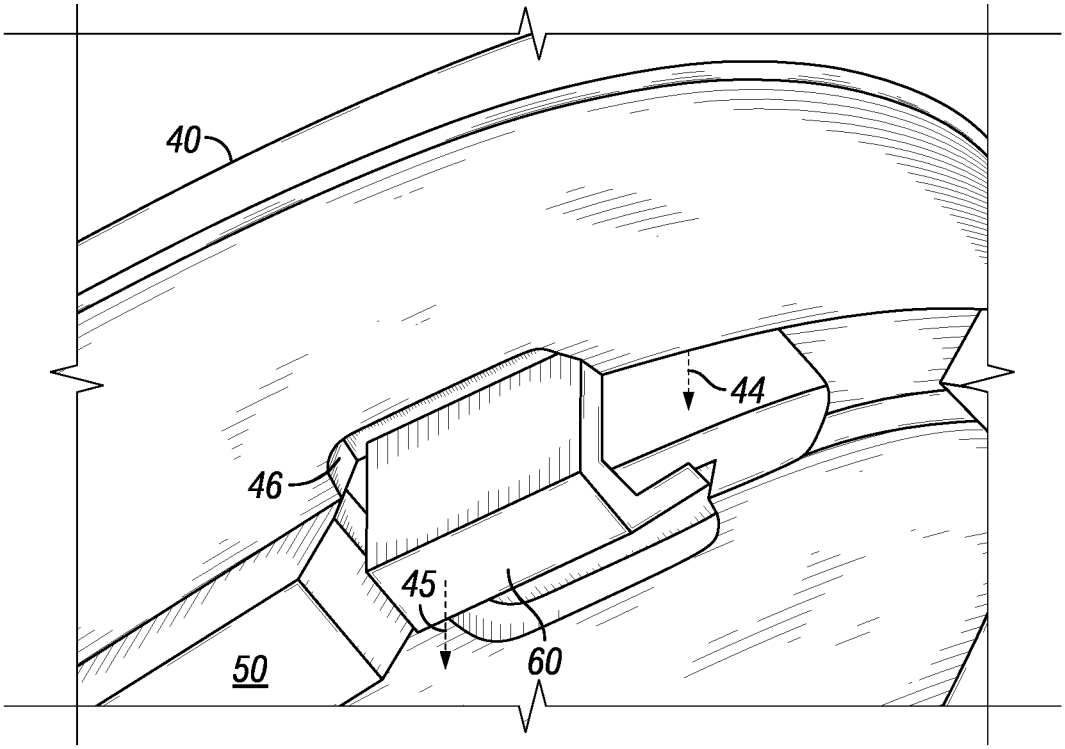
FIG. 9 is a perspective view of an alternate V-shaped, retention-clip style of closure.

Any suitable closure for closing an access opening is also within the scope of this disclosure. FIG. 9 is a perspective view of an alternate closure configuration comprising a V-shaped, retention-clip (i.e., "V-clip") style of closure 60, as viewed from inside the retaining ring 40 looking out the access opening 44. The "V" shape allows the closure 60 to be flexed or otherwise deformed inwardly to fit into the access opening in an insertion direction of the arrow 45 to ensure the segments remain inside the channel. The closure 60 then snaps back outwardly and engages an inner retention surface 46 inside the retaining ring 40 to prevent removal.

Accordingly, the present disclosure provides various apparatus, methods, and tools for securing a component such as a sealing element to a tubular mandrel of a downhole tool. These may include any of the various features disclosed herein, including one or more of the following statements.

Statement 1. An apparatus, comprising: a mandrel defining a mandrel groove circumferentially extending along an outer surface of the mandrel; a retaining ring defining a ring groove circumferentially extending along an inner surface of the retaining ring and an access opening to the ring groove from an outer surface of the retaining ring, the retaining ring positionable around the mandrel to cooperatively define a channel with the ring groove and the mandrel groove; and a plurality of retention segments insertable through the access opening into the channel for axially securing the retaining ring to the mandrel.

Statement 2. The apparatus of Statement 1, further comprising a spring insertable through the access opening into the channel to place the plurality of retention segments in circumferential compression within the channel.

Statement 3. The apparatus of Statement 1 or 2, further comprising: a closure removably securable to the retaining ring to close the access opening and secure the plurality of retention segments in the channel.

Statement 4. The apparatus of any of Statements 1 to 3, wherein the plurality of retention segments comprise two end segments disposed in the channel on opposing sides of the access opening, and the closure extends radially into the channel between the two end segments.

Statement 5. The apparatus of Statement 4, wherein at least one of the end segments has an interlocking end that interlocks with the closure extending radially into the channel.

Statement 6. The apparatus of Statement 5, wherein the end of the at least one of the end segments circumferentially overlaps with a portion of the closure.

Statement 7. The apparatus of any of Statements 1 to 6, further comprising a key formed along one or both of the ring groove and the mandrel groove to limit circumferential movement of the retention segments along the channel.

Statement 8. The apparatus of any of Statements 1 to 7, wherein the plurality of retention segments span at least 180 degrees of the channel.

Statement 9. The apparatus of any of Statements 1 to 8, wherein one or more of the retention segments comprise a stepped cross section including a radially-inner portion and a radially-outer portion, the radially-outer portion having a width greater than a width of the radially-inner portion.

Statement 10. The apparatus of any of Statements 1 to 9, wherein one or more of the retention segments has a beam-shape cross section including one or both of a flanged end slidably captured within the ring groove and a flanged end slidably captured within the mandrel groove when inserted in the channel.

Statement 11. The apparatus of any of Statements 1 to 10, further comprising: a sealing member secured to the mandrel by the retaining ring and configured for deploying outwardly from the mandrel.

Statement 12. A downhole tool, comprising: a mandrel defining a mandrel groove circumferentially extending along an outer surface of the mandrel; a retaining ring defining a ring groove circumferentially extending along an inner surface of the retaining ring and an access opening to the ring groove from an outer surface of the retaining ring, the retaining ring positionable around the mandrel to cooperatively define a channel with the ring groove and the mandrel groove; a plurality of retention segments insertable through the access opening into the channel for axially securing the retaining ring to the mandrel; a spring insertable through the access opening into the channel to place the plurality of retention segments in circumferential compression within the channel; and a sealing member secured to the mandrel by the retaining ring and configured for deploying outwardly from the mandrel.

Statement 13. The downhole tool of Statement 12, further comprising: a closure removably securable to the retaining ring to close the access opening and secure the plurality of retention segments in the channel; wherein the plurality of retention segments comprise two end segments disposed in the channel on opposing sides of the access opening, and the closure extends radially into the channel between the two end segments; and wherein each end segment has an interlocking end that interlocks with the closure by circumferentially overlapping with a portion of the closure when in compressive engagement from the compression spring.

Statement 14. A method of securing a component to a well tool, comprising: positioning a retainer ring on a mandrel of the well tool; and inserting a plurality of retention segments through an access opening on a retainer ring and into a channel defined between a ring groove on the retainer ring and a mandrel groove on the mandrel.

Statement 15. The method of Statement 14, further comprising: securing a closure to the retaining ring to close the access opening after inserting the plurality of retention segments into the channel.

Statement 16. The method of Statement 14 or 15, further comprising inserting a compression spring through the access opening into the channel to place the plurality of retention segments in circumferential compression within the channel.

Statement 17. The method of any of Statements 14 to 16, further comprising filling at least 180 degrees of the channel with the plurality of retention segments.

Statement 18. The method of any of Statements 14 to 17, further comprising securing a sealing member to the mandrel with the retaining ring.

Statement 19. The method of Statement 18, further comprising: further securing the sealing member to the mandrel by positioning a second retainer ring about the mandrel and inserting a second plurality of retention segments through an access opening on the second retainer ring and into a channel defined between a ring groove on the second retainer ring and another mandrel groove on the mandrel.

Statement 20. The method of any of Statements 14 to 19, wherein each retention segment comprises a circular cross-section, a stepped cross section, or a beam-shaped cross section.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An apparatus, comprising:

a mandrel defining a mandrel groove circumferentially extending along an outer surface of the mandrel;

a retaining ring defining a ring groove circumferentially extending along an inner surface of the retaining ring and an access opening to the ring groove from an outer surface of the retaining ring, the retaining ring positionable around the mandrel to cooperatively define a channel with the ring groove and the mandrel groove;

a plurality of retention segments insertable through the access opening into the channel for axially securing the retaining ring to the mandrel, wherein the plurality of retention segments comprise two end segments disposed in the channel on opposing sides of the access opening; and a spring insertable through the access opening into the channel to place the plurality of retention segments in circumferential compression within the channel;

wherein each end segment has an interlocking end that interlocks with a closure by circumferentially overlapping with a portion of the closure when in compressive engagement from the spring.

2. The apparatus of claim 1, further comprising:

the closure removably securable to the retaining ring to close the access opening and secure the plurality of retention segments in the channel.

3. The apparatus of claim 2, wherein the closure extends radially into the channel between the two end segments.

4. The apparatus of claim 1, wherein the plurality of retention segments spans at least 180 degrees of the channel.

5. The apparatus of claim 1, further comprising:

a sealing member secured to the mandrel by the retaining ring and configured for deploying outwardly from the mandrel.

6. An apparatus, comprising:

a mandrel defining a mandrel groove circumferentially extending along an outer surface of the mandrel;

a retaining ring defining a ring groove circumferentially extending along an inner surface of the retaining ring and an access opening to the ring groove from an outer surface of the retaining ring, the retaining ring positionable around the mandrel to cooperatively define a channel with the ring groove and the mandrel groove; and a plurality of retention segments insertable through the access opening into the channel for axially securing the retaining ring to the mandrel, wherein one or more of the retention segments comprise a stepped cross section including a radially-inner portion and a radially-outer portion, the radially-outer portion having a width greater than a width of the radially-inner portion, wherein the plurality of retention segments comprise two end segments disposed in the channel on opposing sides of the access opening, and a closure extends radially into the channel between the two end segments, and wherein end segment has an interlocking end that interlocks with the closure by circumferentially overlapping with a portion of the closure when in compressive engagement from a compression spring.

7. An apparatus, comprising:

a mandrel defining a mandrel groove circumferentially extending along an outer surface of the mandrel;

a retaining ring defining a ring groove circumferentially extending along an inner surface of the retaining ring and an access opening to the ring groove from an outer surface of the retaining ring, the retaining ring positionable around the mandrel to cooperatively define a channel with the ring groove and the mandrel groove; and a plurality of retention segments insertable through the access opening into the channel for axially securing the retaining ring to the mandrel, wherein one or more of the retention segments has a beam-shape cross section including one or both of a flanged end slidably captured within the ring groove and a flanged end slidably captured within the mandrel groove when inserted in the channel, wherein the plurality of retention segments comprise two end segments disposed in the channel on opposing sides of the access opening, wherein each end segment has an interlocking end that interlocks with a closure by circumferentially overlapping with a portion of the closure when in compressive engagement from a compression spring.

8. A downhole tool, comprising:

a mandrel defining a mandrel groove circumferentially extending along an outer surface of the mandrel;

a retaining ring defining a ring groove circumferentially extending along an inner surface of the retaining ring and an access opening to the ring groove from an outer surface of the retaining ring, the retaining ring positionable around the mandrel to cooperatively define a channel with the ring groove and the mandrel groove;

a plurality of retention segments insertable through the access opening into the channel for axially securing the retaining ring to the mandrel, wherein the plurality of retention segments comprise two end segments disposed in the channel on opposing sides of the access opening, and a closure extends radially into the channel between the two end segments;

a spring insertable through the access opening into the channel to place the plurality of retention segments in circumferential compression within the channel;

a sealing member secured to the mandrel by the retaining ring and configured for deploying outwardly from the mandrel;

the closure removably securable to the retaining ring to close the access opening and secure the plurality of retention segments in the channel; and wherein each end segment has an interlocking end that interlocks with the closure by circumferentially overlapping with a portion of the closure when in compressive engagement from the spring.

9. A method of securing a component to a well tool, comprising:

positioning a retainer ring on a mandrel of the well tool; and inserting a plurality of retention segments through an access opening on a retainer ring and into a channel defined between a ring groove on the retainer ring and a mandrel groove on the mandrel, wherein the plurality of retention segments comprise two end segments disposed in the channel on opposing sides of the access opening wherein each end segment has an interlocking end that interlocks with a closure by circumferentially overlapping with a portion of the closure when in compressive engagement from a compression spring.

* * * * *